US010980305B2

(12) United States Patent
Bacinska et al.

(10) Patent No.: US 10,980,305 B2
(45) Date of Patent: Apr. 20, 2021

(54) LENGTH ADJUSTABLE SHROUD USABLE WITH HELMET AND EARMUFFS

(71) Applicant: Honeywell International Inc., Morris Plains, NJ (US)

(72) Inventors: Jana Bacinska, Bratislava (SK); Tanguy Prevot, Bruno-Venkov (CZ); Stanislav Maliarik, Brno (CZ)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 16/152,039

(22) Filed: Oct. 4, 2018

(65) Prior Publication Data

US 2019/0104796 A1 Apr. 11, 2019

Related U.S. Application Data

(60) Provisional application No. 62/568,694, filed on Oct. 5, 2017.

(51) Int. Cl.
*A42B 3/04* (2006.01)
*A42B 3/22* (2006.01)
(Continued)

(52) U.S. Cl.
CPC ..... *A42B 3/0406* (2013.01); *A42B 1/04* (2013.01); *A42B 3/08* (2013.01); *A42B 3/105* (2013.01); *A42B 3/225* (2013.01)

(58) Field of Classification Search
CPC ..... A42B 3/105; A42B 3/286; A42B 3/10; A42B 3/225; A42B 3/288; A42B 3/221;
(Continued)

(56) References Cited

U.S. PATENT DOCUMENTS 645,286 A * 3/1900 Bader ..... A62B 17/04 128/201.23
1,075,906 A * 10/1913 Duncan et al. ..... A62B 17/04 128/201.23

(Continued)

FOREIGN PATENT DOCUMENTS

CN 106726137 A 5/2017
EP 3203687 A1 8/2017

OTHER PUBLICATIONS https://www.thefreedictionary.com/shroud; from Collins English Dictionary—Complete and Unabridged, 12th Edition 2014 © HarperCollins Publishers 1991, 1994, 1998, 2000, 2003, 2006, 2007, 2009, 2011, 2014 (Year: 2014).*

(Continued)

*Primary Examiner* — Robert H Muromoto, Jr.
(74) *Attorney, Agent, or Firm* — Alston & Bird LLP

(57) ABSTRACT

A system for adjustably and removably attaching a shroud to a helmet. The shroud for use with a helmet has a top shroud configured to attach to the helmet; an inner shroud configured to attach to the top shroud. The inner shroud has a band configured to tighten around a user's neck and an outer shroud configured to removably attach to the top shroud. The outer shroud is further configured to cover a user's shoulders. The shroud also has one or more removable attachments, wherein the top shroud attaches to the helmet via the one or more removable attachments.

19 Claims, 12 Drawing Sheets

(51) Int. Cl.

| | |
|---|---|
| ***A42B 3/08*** | (2006.01) |
| ***A42B 1/04*** | (2021.01) |
| ***A42B 3/10*** | (2006.01) |
| *A42B 1/18* | (2006.01) |

(58) Field of Classification Search

CPC ..... A42B 3/003; A42B 3/228; A42B 1/067; A62B 17/04; A62B 18/04; A62B 17/001; A62B 9/04; A62B 18/02; A62B 18/08; A62B 18/084; A62B 17/008; A62B 18/00; A62B 7/10; A41D 13/1153; A41D 13/11; A41D 13/1218; A41D 13/0512; A41D 2200/20; A41D 2400/52; A41D 13/02; A41D 13/0518; A41D 2400/44; A41D 13/002; A41D 13/1184; A41D 13/12; A41D 13/1209; A41D 27/18; A41D 31/08

See application file for complete search history.

(56) References Cited

U.S. PATENT DOCUMENTS 1,131,350 A * 3/1915 Engelfried et al. .... A62B 17/04 128/201.23
1,148,902 A * 8/1915 Jacobs ..... A42B 3/08 2/421
1,184,785 A * 5/1916 Stern ..... A62B 18/02 128/201.15
1,872,877 A * 8/1932 Bowers ..... A62B 18/04 128/201.15
2,189,892 A * 2/1940 Fox ..... A42B 1/067 2/4
2,377,122 A * 5/1945 Bakke ..... A61F 9/068 128/201.25
2,529,106 A * 11/1950 Schauweker ..... A62B 17/04 128/201.25
3,058,463 A * 10/1962 Goodrich, Jr. ..... A41D 13/11 128/863
3,100,896 A * 8/1963 Khanbegian ..... A42B 3/105 2/5
3,310,811 A * 3/1967 Iacono, Jr. ..... A42B 3/08 2/6.5
3,535,706 A 10/1970 Aileo
3,562,813 A * 2/1971 Origer ..... A61F 9/022 2/410
3,825,952 A * 7/1974 Pershing ..... A42B 3/105 2/422
4,017,906 A * 4/1977 Bochynsky ..... A42B 3/0473 2/10
4,042,976 A * 8/1977 Reynolds ..... A41D 23/00 2/135
4,172,294 A * 10/1979 Harris ..... A62B 18/04 2/171.3
4,180,868 A * 1/1980 Snow ..... A42B 3/105 2/203
D255,283 S * 6/1980 Piche ..... D24/110.3
4,236,514 A * 12/1980 Moretti ..... A62B 17/04 128/201.23
4,352,353 A 10/1982 Bolton et al.
4,466,432 A * 8/1984 Wise ..... A62B 17/04 128/201.23
4,542,538 A * 9/1985 Moretti ..... A62B 18/082 2/205
4,697,289 A * 10/1987 Luigi ..... A42B 3/105 2/205
4,901,716 A * 2/1990 Stackhouse ..... A41D 13/1153 128/201.25
4,975,980 A * 12/1990 Ersteniuk ..... A42B 3/105 2/172
5,003,974 A * 4/1991 Mou ..... A62B 17/04 128/201.25
5,042,474 A * 8/1991 Williamson ..... A41D 13/11 128/201.24
5,056,512 A * 10/1991 Bower ..... A62B 17/04 128/201.25
5,095,550 A * 3/1992 Perlinger ..... A42B 3/105 2/410
5,133,344 A * 7/1992 Jurrius ..... A62B 17/04 128/201.23
5,163,185 A * 11/1992 Hodnett ..... A42B 3/26 2/422
5,318,018 A * 6/1994 Puma ..... A62B 17/008 128/202.11
5,493,734 A * 2/1996 Nieves-Rivera ..... A42B 3/105 2/172
5,549,104 A * 8/1996 Crump ..... A61F 9/028 128/201.25
5,701,609 A * 12/1997 Bridges ..... A42B 3/105 2/172
6,016,805 A * 1/2000 Burns ..... A42B 3/288 128/206.24
6,035,451 A * 3/2000 Burns ..... A42B 3/225 2/424
6,163,891 A * 12/2000 Viitalahti ..... A42B 3/105 2/421
6,279,573 B1 * 8/2001 Johnson ..... A62B 9/04 128/202.27
6,295,652 B1 * 10/2001 Mazur ..... A42B 3/0473 2/422
6,371,116 B1 * 4/2002 Resnick ..... A62B 17/04 128/201.22
6,401,259 B1 6/2002 Epperson et al.
6,481,019 B2 * 11/2002 Diaz ..... A41D 13/11 128/201.19
6,622,311 B2 * 9/2003 Diaz ..... A41D 13/11 128/200.28
6,817,358 B1 * 11/2004 Resnick ..... A62B 17/04 128/201.22
6,862,749 B1 * 3/2005 Krause ..... A42B 3/105 2/422
6,918,141 B2 * 7/2005 Green ..... A41D 13/1153 128/201.23
6,990,691 B2 * 1/2006 Klotz ..... A41D 13/1153 2/171.3
7,007,690 B1 * 3/2006 Grove ..... A62B 18/00 128/201.25
7,636,955 B2 * 12/2009 Plut ..... A41D 13/002 2/457
7,677,245 B2 * 3/2010 Borsari ..... A61M 16/06 128/201.29
7,748,060 B2 * 7/2010 Plut ..... A41D 13/02 2/457
7,779,485 B2 * 8/2010 Gandy ..... A41D 3/00 2/202
8,032,952 B2 * 10/2011 Plut ..... A41D 13/02 2/456
8,201,276 B2 * 6/2012 Asta ..... A42B 3/105 2/205
8,225,428 B2 7/2012 Grilliot et al.
8,234,722 B2 * 8/2012 VanDerWoude ... A41D 13/1153 2/410
9,021,617 B2 * 5/2015 Asta ..... A42B 3/105 2/205
9,999,546 B2 * 6/2018 Gardner ..... A61F 9/068
10,028,544 B2 * 7/2018 Teetzel ..... A42B 3/225
10,226,383 B2 * 3/2019 Ambring ..... A41D 13/08
10,265,553 B2 * 4/2019 Boss ..... A62B 17/04
2002/0174481 A1 * 11/2002 Tremblay-Lutter ... A62B 17/04 2/457
2005/0114974 A1 * 6/2005 Grilliot ..... A42B 3/003 2/5
2006/0248623 A1 * 11/2006 Miller ..... F41H 1/04 2/6.6
2009/0064385 A1 * 3/2009 Crossman ..... A42B 3/105 2/6.6

(56) References Cited

U.S. PATENT DOCUMENTS

| | | | | |
|---|---|---|---|---|
| 2011/0030114 | A1 | 2/2011 | Merikoski et al. | |
| 2014/0298557 | A1* | 10/2014 | Townsend, Jr. ..... | A61F 9/06 2/8.2 |

OTHER PUBLICATIONS https://www.thefreedictionary.com/cowl; from Collins English Dictionary—Complete and Unabridged, 12th Edition 2014 © HarperCollins Publishers 1991, 1994, 1998, 2000, 2003, 2006, 2007, 2009, 2011, 2014 (Year: 2014).*

Europe Patent Application No. 18198865.0, Extended European Search Report, dated Feb. 14, 2019, 5 pages.

Communication pursuant to Rules 70(2) and 70a(2) EPC and reference to Rule 39(1) EPC for EP Application No. 18198865.0, dated Apr. 15, 2019, 2 pages.

Decision to Grant received for EP Application No. 18198865.0, dated Jan. 23, 2020, 2 pages.

Intention to Grant received for EP Application No. 18198865.0, dated Sep. 16, 2019, 66 pages.

* cited by examiner

LENGTH ADJUSTABLE SHROUD USABLE WITH HELMET AND EARMUFFS

CROSS-REFERENCE TO RELATED APPLICATIONS

The present application claims priority to U.S. Provisional Patent Application Ser. No. 62/568,694 filed Oct. 5, 2017 by Jana Bacinska, et al. and entitled "Length Adjustable Shroud Usable with Helmet and Earmuffs" which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

When a worksite may have potentially hazardous elements, such as high noise levels, hazardous materials or chemicals, or dangerous equipment, personal protection equipment (PPE) may be required for a user to enter the worksite. PPE may include ear muffs, hard hats, helmets, boots, goggles, gloves, suits, hoods, gas detectors, protective clothing, hearing protection, bibs, coveralls, safety vests, gas detectors, respiration systems, among other PPE devices. A user may be required to wear multiple PPE devices when entering a work site.

SUMMARY

In an embodiment, a shroud for use with a helmet may comprise a top shroud configured to attach to the helmet; an inner shroud configured to attach to the top shroud, wherein the inner shroud comprises a band configured to tighten around a user's neck; and an outer shroud configured to removably attach to the top shroud, wherein the outer shroud is configured to cover a user's shoulders.

In an embodiment, a method for attaching a shroud to a helmet may comprise removably attaching a shroud to at least a portion of a helmet, wherein the shroud comprises a top shroud, an inner shroud, and an outer shroud; removing the outer shroud while a user is wearing the top shroud and the inner shroud; and protecting the user while wearing the shroud and the helmet.

In an embodiment, a method of making a shroud for use with a helmet may comprise providing a top shroud, an inner shroud, and an outer shroud; permanently attaching the inner shroud to the top shroud; removably attaching the outer shroud to at least one of the top shroud and the inner shroud; and attaching one or more removable attachments configured to attach the shroud to the helmet.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
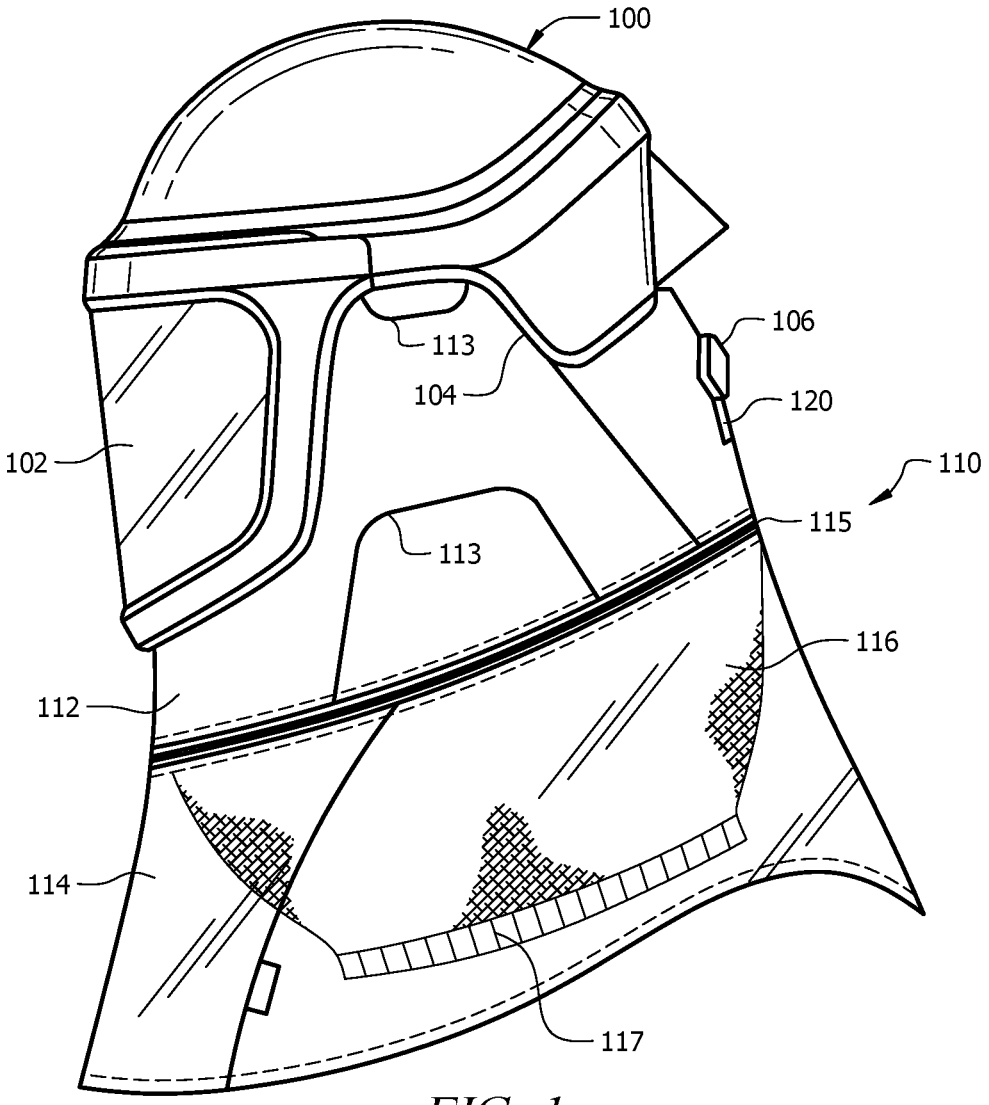
FIG. 1 illustrates a side view of a helmet and shroud according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments of the disclosure include systems and methods for attaching a shroud (or hood) to a helmet, adjust the shroud and/or helmet, and protecting a user while wearing the shroud and/or helmet. The shroud and/or helmet may be worn with a powered air purifying respirator (PAPR) and/or earmuffs.

Typical shroud (or hood) solutions do not allow a user to wear earmuffs, as there is not enough room under the shroud. Some users need a level of hearing protection that requires them to wear earmuffs, and while working in a hazardous environment, the user may also need protection against particles and/or chemicals. Additionally, typical shrouds only allow a user to wear a single length (e.g. typically a long version) of the shroud. Some users may work in multiple environments with different protection requirements, and they may wish to reduce the weight and/or movement restricting nature of the shroud when working in a less hazardous environment. For example, a standard long shroud may protect the user from dust, sparks, molten metal, and/or chemicals. Then, when a user enters an area where only dust protection is needed, a user may remove such a standard long shroud for comfort reasons, thereby removing the protection from chemicals but maintaining the protection from dust. The user may also remove the helmet with the shroud, removing the head protection. The presently disclosed embodiments provide multiple configurations for the user to change (e.g. depending upon the environment), for example with a removable long shroud that can be used when more protection is needed, and a shorter shroud portion which can be used with or without the removable long shroud (providing the option for increased comfort when less protection is needed).

Embodiments described herein include embodiments of a shroud and/or helmet configured to fit around earmuffs. The shroud may allow a user to wear earmuffs under the shroud without becoming cumbersome or oversized. The shroud may be made of a textile material, and the shroud pattern is designed to fit different sizes of earmuffs. The shroud may attach to the helmet via removable attachments.

Additionally, embodiments include a shroud comprising a "length adjustable" shroud, with a removable outer shroud (which is longer) and an inner shroud (which is shorter and/or more fitted), where the outer shroud may be removed by a user when entering a less hazardous work environment. The shorter version (e.g. including only the inner shroud) may provide increased comfort to a user than the long version (including by the inner shroud and outer shroud) while still protecting the head and neck of a user. This modular "length adjustable" shroud could be considered as a neck seal with extra (removably attached) skirt to become a full shroud when needed.

Typically, the inner shroud (e.g. neck seal) is permanently attached to the top shroud (which for example is configured to removably attach to a helmet and/or to cover a user's face and/or earmuffs and/or PAPR), and the outer shroud is configured to removably attach to the top shroud and/or the inner shroud (for example by zipper attachment). Typically, the inner shroud is shorter and closer-fitting than the outer shroud, such that when both are worn, the inner shroud is completely contained within/under the outer shroud. The removable outer shroud typically fits around a user's shoulder area. It should be easy for a worker to switch from the long version to the short version of the protective shroud by simply unzipping the outer shroud. The inner shroud covers the user's neck and collar, and may comprise a soft ribbed hem opening with an adjustable and/or elastic band (e.g. on the bottom, to provide a close fit to a user's neck, for example to reduce infiltration of particulates). In some cases, the shroud may comprise one of a plurality of protection levels, such as disposable, standard, and/or premium (for example).

Referring now to FIG. 1, a side view of an exemplary helmet 100 with an exemplary shroud 110 is shown. The helmet 100 may comprise a head portion 104 and a face shield 102. The shroud 110 may comprise a top shroud 112 (e.g. configured to cover/shield the user's head and/or to (removably) attach to the helmet 100 and/or shaped for use of a particular helmet), an outer shroud 114 (shown as being transparent simply for convenience), and an inner shroud 116. The inner shroud 116 may attach to the top shroud 112, either permanently or removably. The outer shroud 114 may attach to the top shroud 112, either permanently or removably (or in other embodiment, the outer shroud 114 may attach to the inner shroud 116). In some embodiments, the shroud 110 may comprise one or more zipper 115 (or other similar removable attachment element) configured to attach the outer shroud 114 and/or the inner shroud 116 to the top shroud 112. In some embodiments, the outer shroud 114 may be removed using the zipper 115 (e.g. by unzipping the outer shroud 114 from the shroud 112 and then doffing the outer shroud 114). In some embodiments the zipper 115 may comprise a reversed nylon zipper, where the zipper 115 may be accessed underneath the outer shroud 114. In some embodiments, the zipper 115 may overlap itself on the backside of the shroud 110.

The inner shroud 116 may comprise a band 117 configured to tighten the fit of the inner shroud 116 against a user's neck (e.g. to provide a snug fit around the user's neck). In some embodiments, the band 117 may comprise an elastic material. In some embodiments, the band 117 may comprise a loop that can be tightened. In some embodiments, the top shroud 112 may comprise one or more strips of reflective piping 113.

The helmet 100 may comprise an adjustment wheel 106 configured to adjust the fit of the head portion 104 of the helmet 100 (e.g. the inside of the helmet to fit different head sizes). The adjustment wheel 106 may need to be accessible outside of the shroud 110 while the user is wearing the helmet 100 and shroud 110, so the shroud 110 may comprise a button hole 120 configured to allow the adjustment wheel 106 to extend out of the shroud 110 while still sealing the interior of the shroud 110 (e.g. from particulates, so the user's protection is not compromised). In some embodiments, the button hole 120 may comprise overlapping welts.

Figure 2:
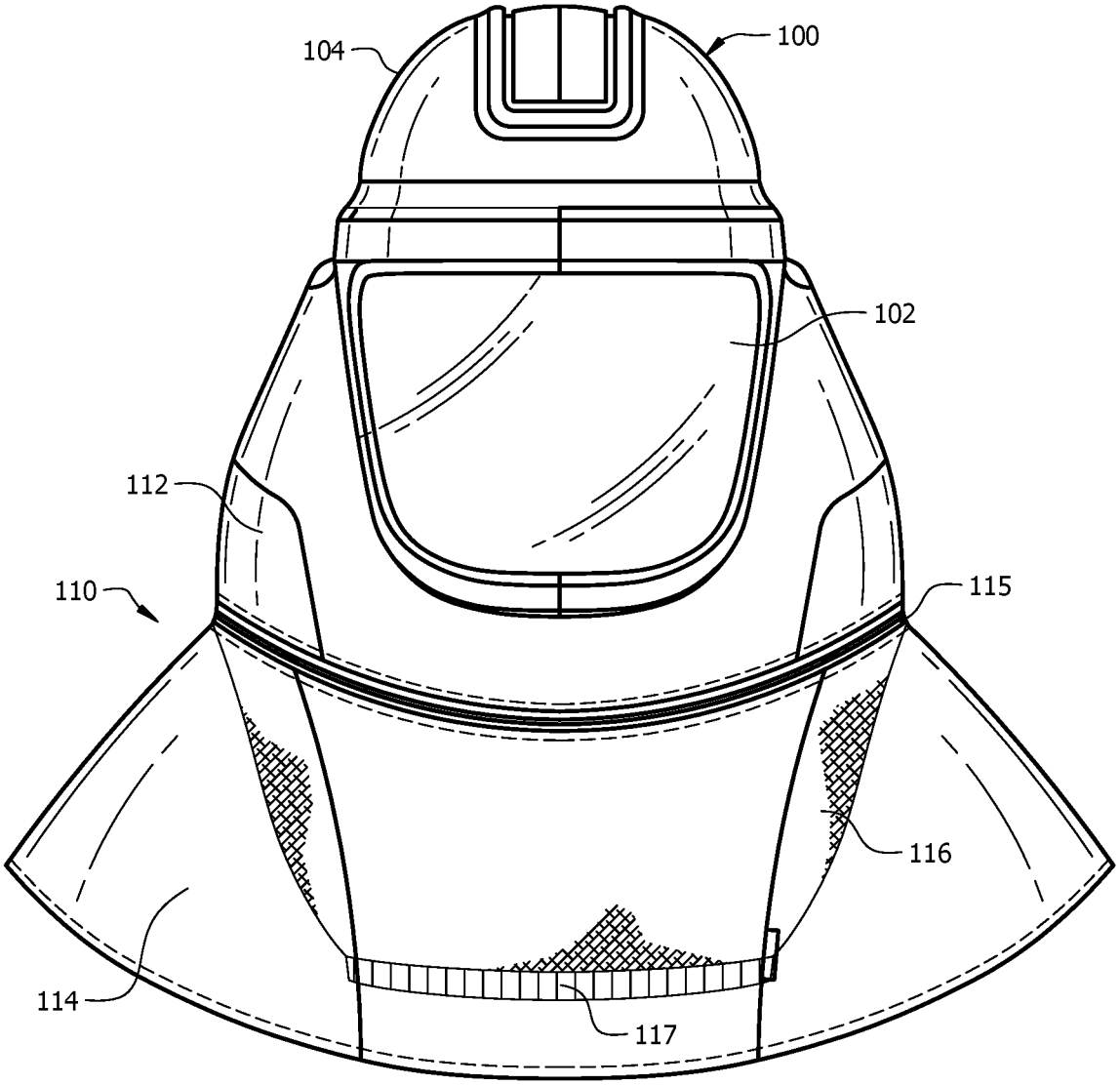
FIG. 2 illustrates a front view of a helmet and shroud according to an embodiment of the disclosure.

FIG. 2 illustrates a front view of the helmet 100 and shroud 110 of FIG. 1.

Figure 3:
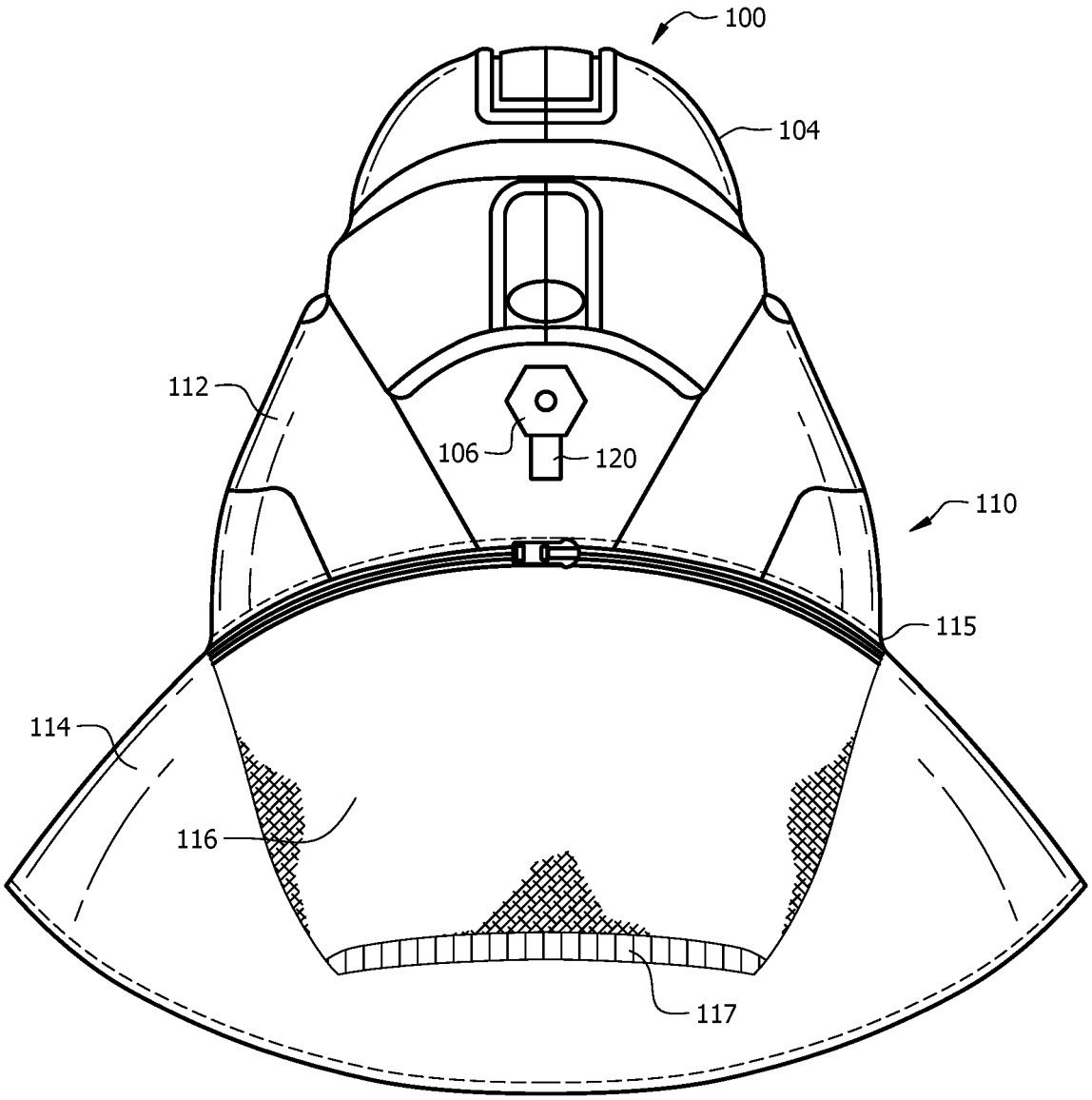
FIG. 3 illustrates a back view of a helmet and shroud according to an embodiment of the disclosure.

FIG. 3 illustrates a back view of the helmet 100 and shroud 110 of FIG. 1, where the adjustment wheel 106 and button hole 120 may be seen in more detail.

In some embodiments, the shroud 110 may comprise one material that is used for the top shroud 112, inner shroud 116, and outer shroud 114. In other embodiments, the shroud 110 may comprise more than one material that is used for the top shroud 112, inner shroud 116, and outer shroud 114, where one or more of the pieces of the shroud 110 may comprise different materials. In some embodiments, the shroud 110 may be made to be any of a plurality of protection levels.

As an example, the shroud 110 may comprise a "premium" shroud, configured to be worn multiple times. The premium shroud may be washable and reusable. The premium shroud may comprise a fabric (or material) configured to block dust and chemicals, and/or may be flame retardant. As an example, the premium shroud may comprise a Kevlar® material.

As another example, the shroud 110 may comprise a "standard" shroud, configured to be worn multiple times. The standard shroud may be washable and reusable. The standard shroud may comprise a fabric (or material) configured to block dust. As an example, the standard shroud may comprise a cotton/twill material.

As another example, the shroud 110 may comprise a "disposable" shroud that is intended for a single use. The disposable shroud may provide dust protection while the user is wearing it. The disposable shroud may comprise a thinner and/or cheaper fabric (or material) when compared to the other shrouds described above. As an example, the disposable shroud may comprise a polypropylene material.

The premium shroud, standard shroud, and disposable shroud may optionally comprise a removable outer shroud 114 and inner shroud 116 as described above (e.g. attached to a top shroud 112, for example with the outer shroud 114 removably attached). In an alternative embodiment, one or more of the premium shroud, standard shroud, and disposable shroud may comprise only the outer shroud 114 or inner shroud 116. In yet another embodiment, one or more of the premium shroud, standard shroud, and disposable shroud may comprise both the outer shroud 114 and inner shroud 116, where the outer shroud 114 is not removable.

Figure 4:
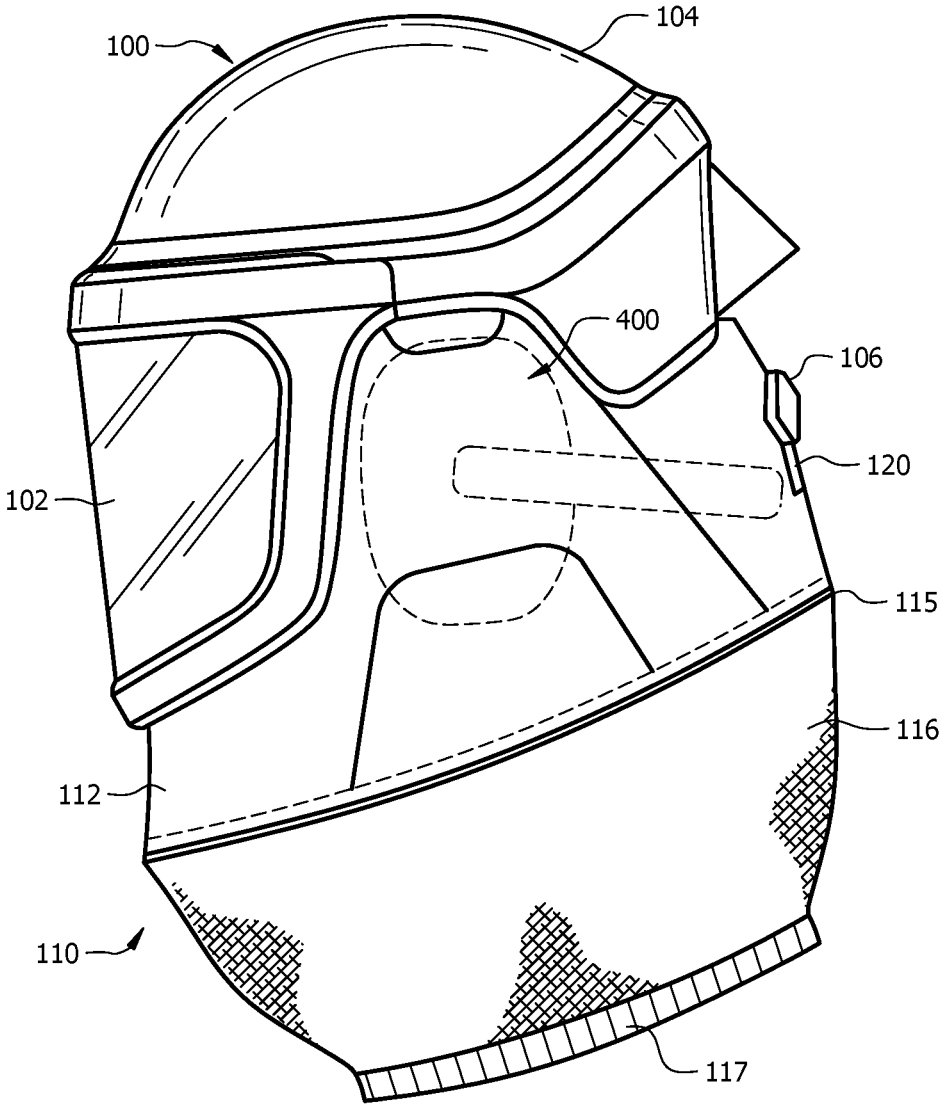
FIG. 4 illustrates another side view of a helmet and shroud according to an embodiment of the disclosure.

FIG. 4 illustrates an embodiment of the helmet 100 and shroud 110 where the outer shroud 114 (shown above) has been removed (via the zipper 115). In some use cases, a user may wish to reduce the weight of the shroud when the user is working in a less hazardous environment that does not require the protection of the outer shroud 114. Additionally, FIG. 4 illustrates how the shroud 110 may be worn while a user is wearing earmuffs 400 (which may also be called hearing protection and/or a headset). The top shroud 112 may be shaped to fit around the earmuffs 400 while still providing protection to the user. For example, an elastic band may be stretched within the top shroud 112 and configured so that it reduces the fabric volume when no earmuff is present, but it expands the fabric volume when an earmuff is present to allow for comfortable but secure fit.

Figure 5:
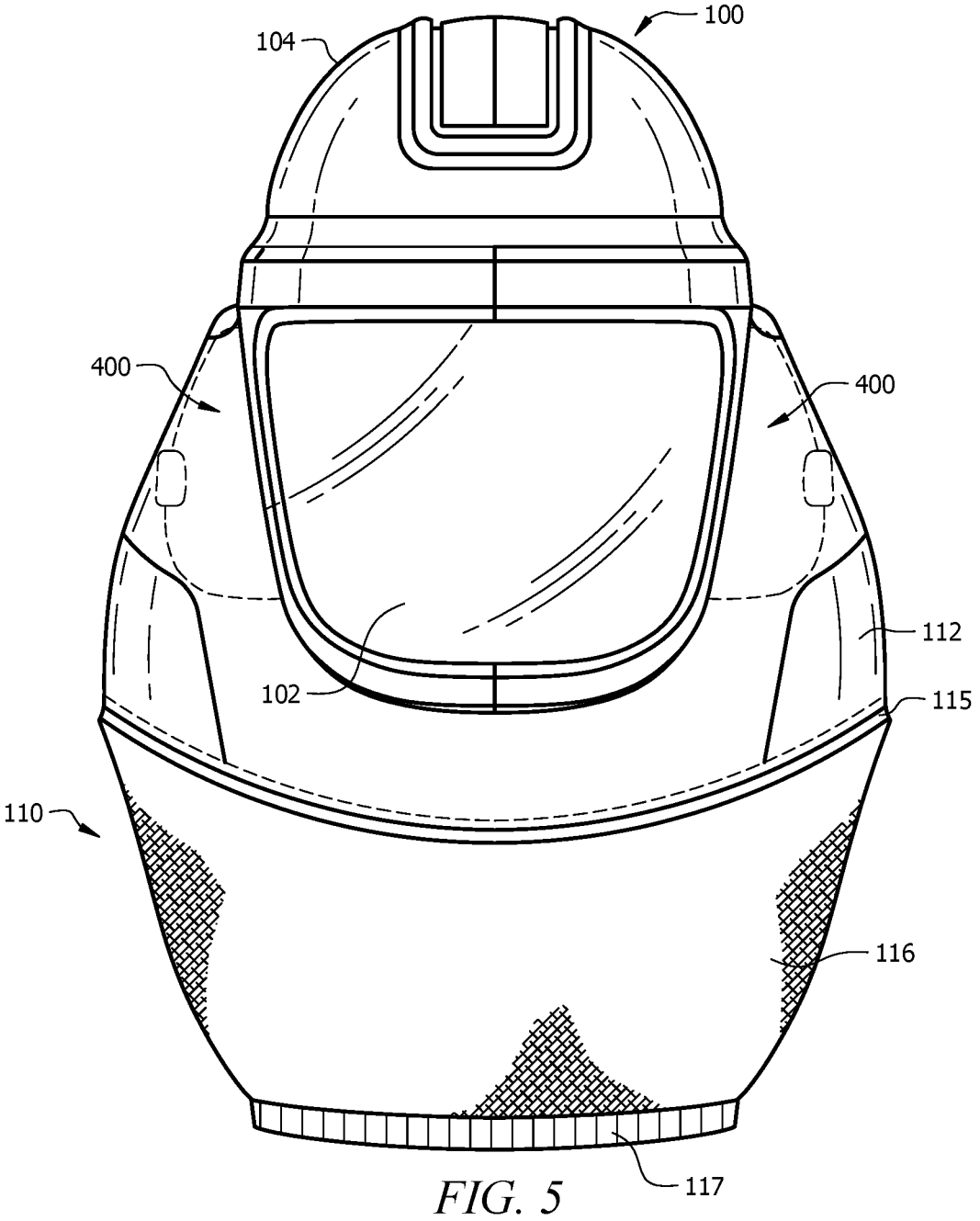
FIG. 5 illustrates another front view of a helmet and shroud according to an embodiment of the disclosure.

FIG. 5 illustrates a front view of the helmet 100 and shroud 110 with the outer shroud 114 removed, and with the earmuffs 400.

Figure 6:
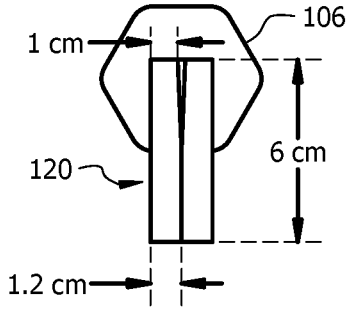
FIG. 6 illustrates a detail view of an adjustment wheel of a helmet and a button hole of a shroud according to an embodiment of the disclosure.

FIG. 6 illustrates a detailed view of the adjustment wheel 106 and button hole 120, and includes an example of the dimensions of the elements of the button hole 120. For example, the button hole welts might overlap on the bottom by 4 mm.

Figure 7:
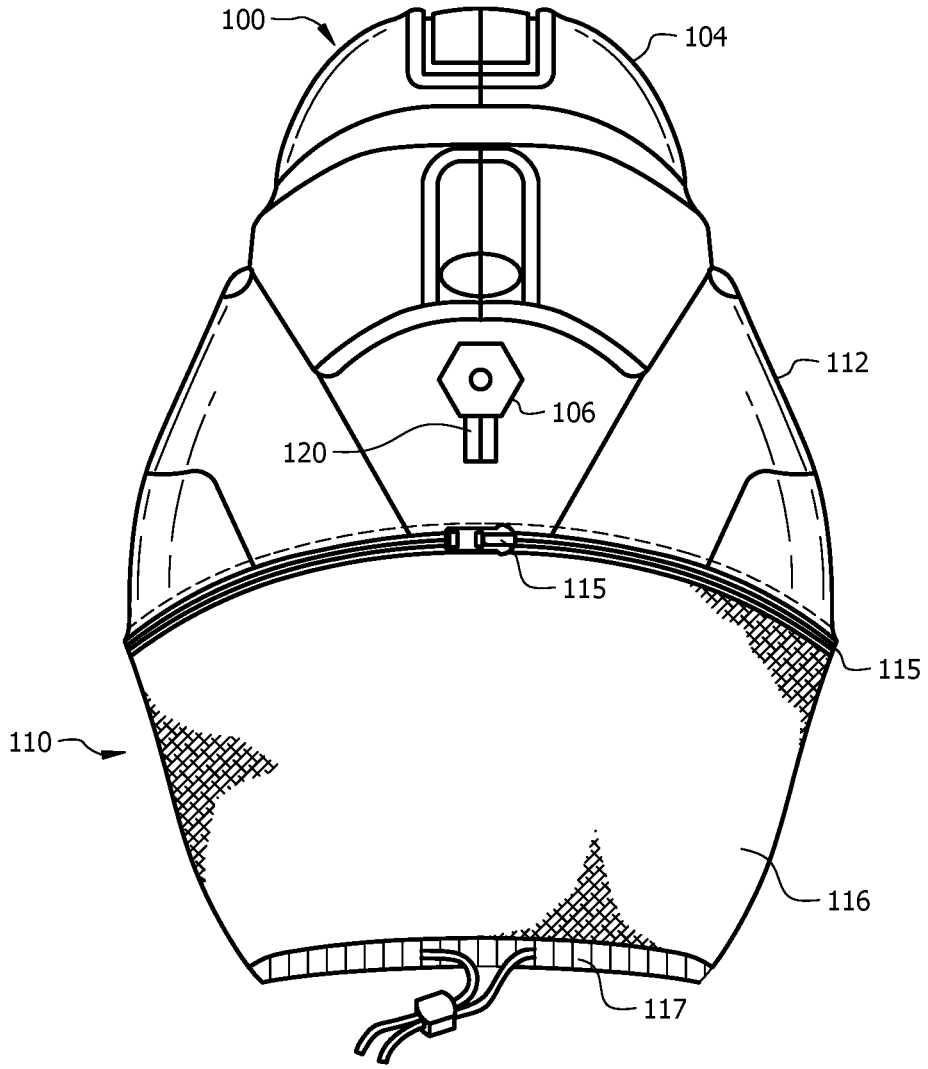
FIG. 7 illustrates another back view of a helmet and shroud according to an embodiment of the disclosure.

FIG. 7 illustrates a back view of the helmet 100 and shroud 110 with the outer shroud removed. Here, the overlapping zipper can be clearly seen.

Figure 8:
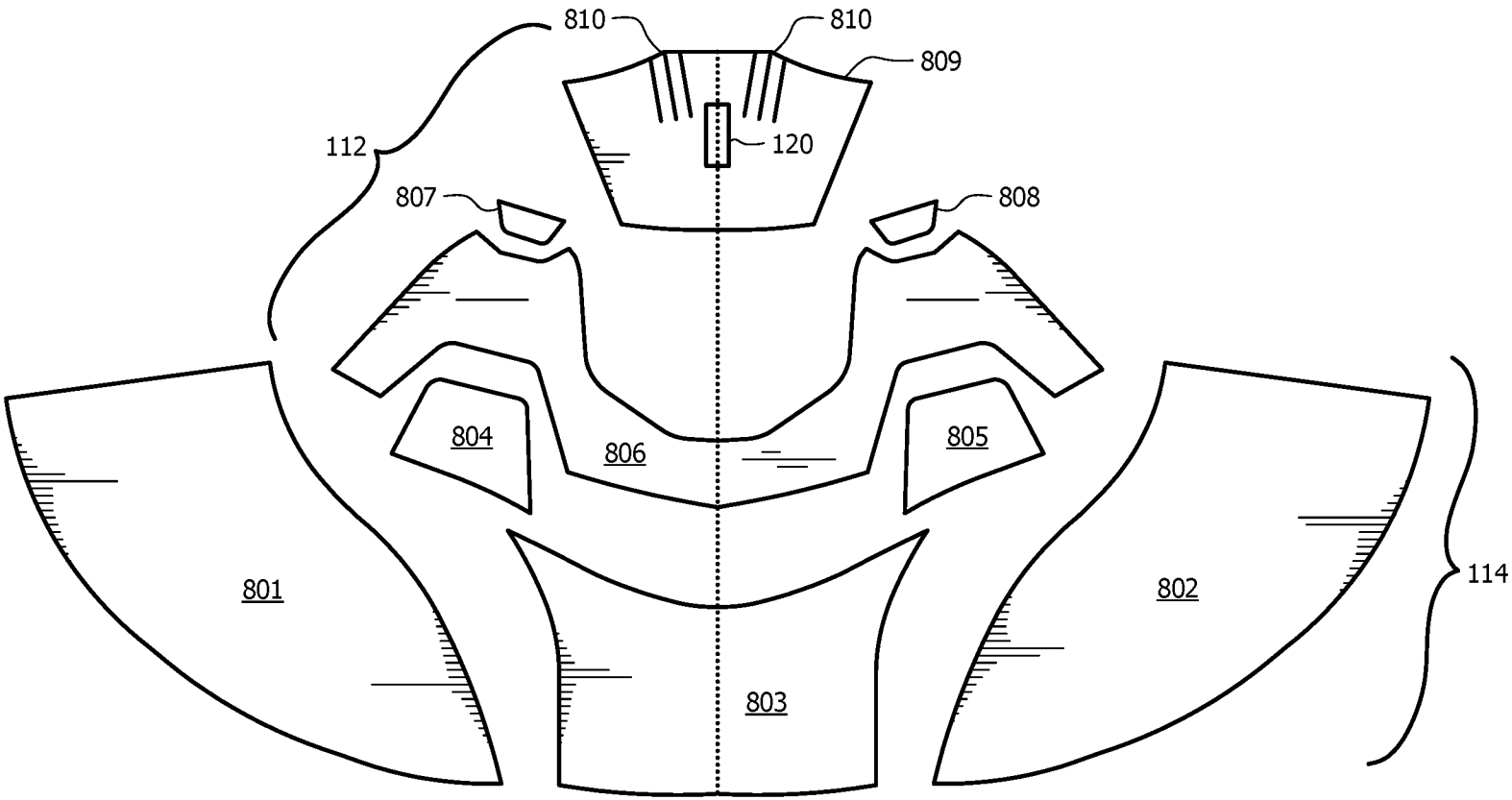
FIG. 8 illustrates a disassembled view of a shroud for use with a helmet according to an embodiment of the disclosure.
Figure 9B:
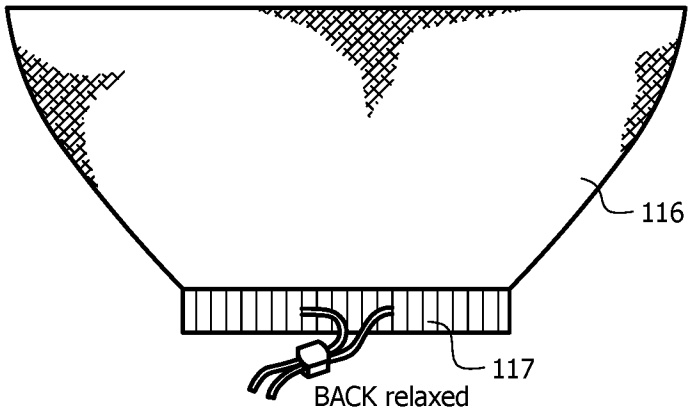
FIGS. 9A-9D illustrate detailed views of a portion of a shroud according to an embodiment of the disclosure.
Figure 9A:
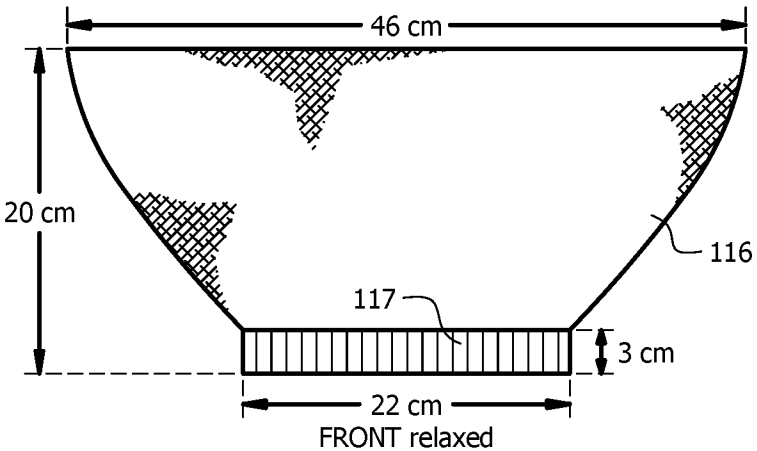
Figure 9D:
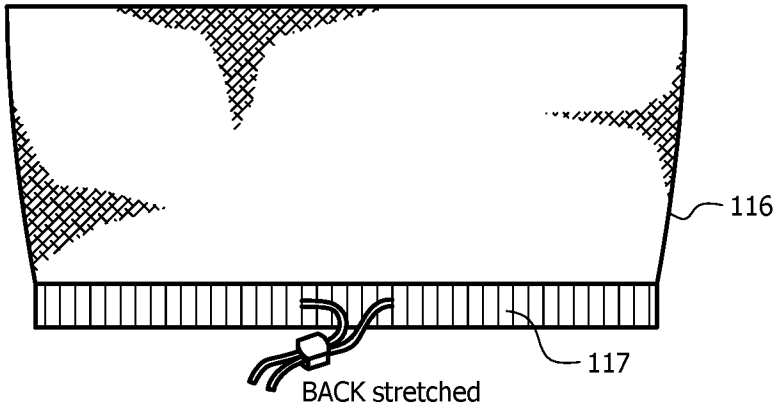
Figure 9C:
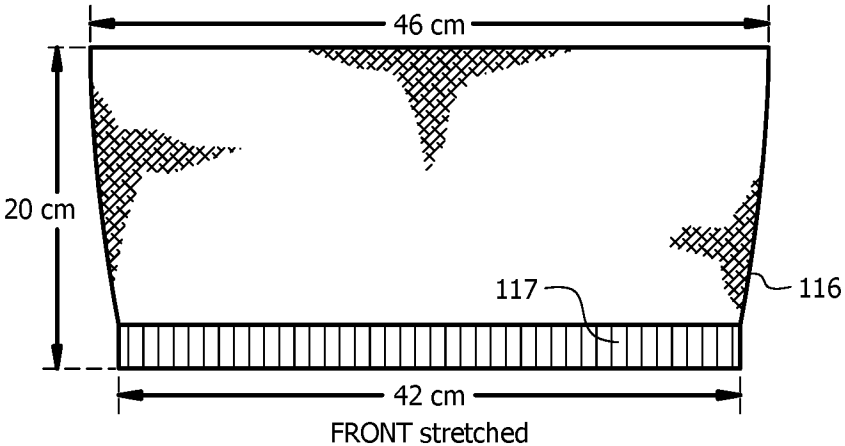

Referring now to FIG. 8, an exploded view of the top shroud 112 and outer shroud 114 is shown (e.g. the various panels of the shroud that are (sealingly) joined to form the shroud). The top shroud 112 may comprise a top side portion 806 configured to attach to a bottom left portion 804, a bottom right portion 805, a top left portion 807, and a top right portion 808. Also, the top side portion 806 may attach to a back top portion 809, where the back top portion 809 comprises the button hole 120. Additionally, the back top portion 809 may comprise one or more pleats 810 configured to improve the fit of the top shroud 112 with the helmet.

The outer shroud 114 may comprise a bottom left side 801, a front 803, and a bottom right side 802. These pieces may attach to one another to completely cover the neck and shoulder area of a user.

Referring now to FIGS. 9A-9D, detailed views of the inner shroud 116 are shown, including an example of the dimensions of the inner shroud 116. FIGS. 9A-9D illustrate the band 117 of the inner shroud 116 in both relaxed and stretched states.

Figure 10:
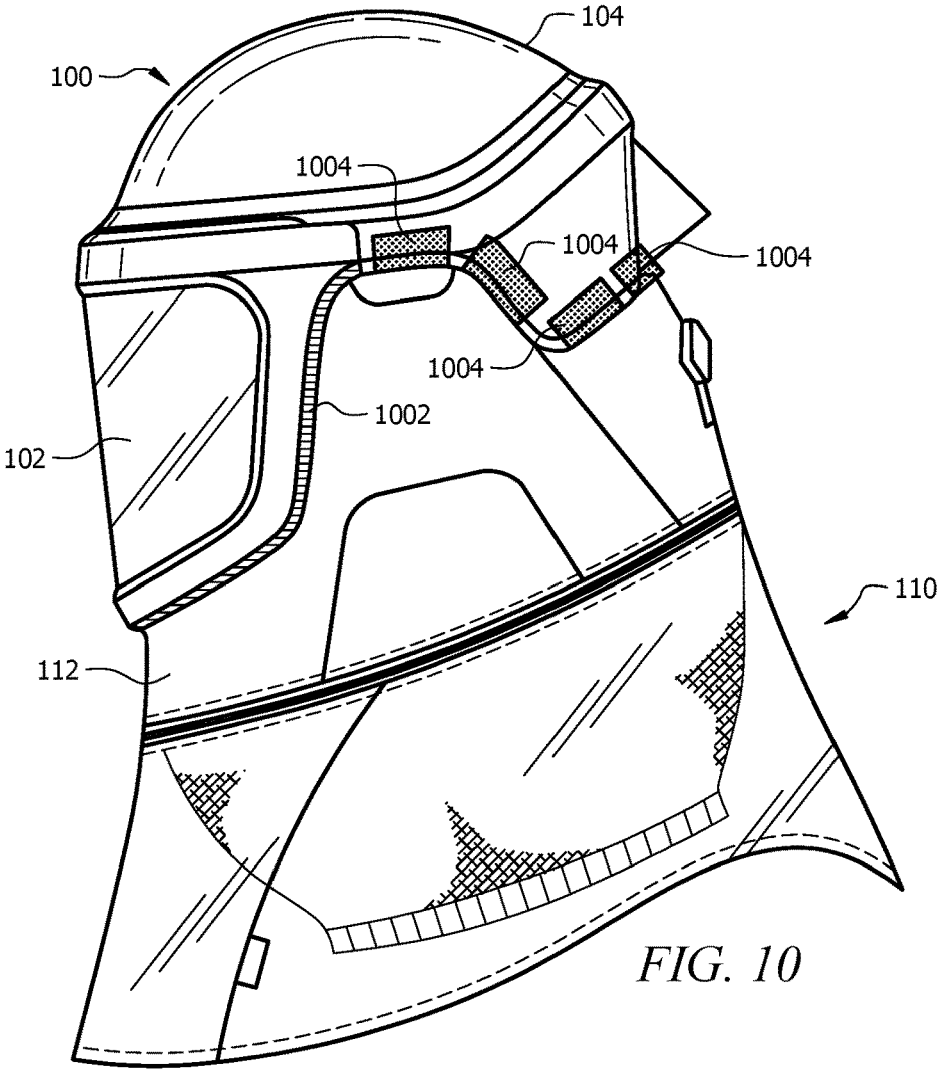
FIG. 10 illustrates a side view of a helmet and shroud comprising an attachment system according to an embodiment of the disclosure.

FIG. 10 illustrates a side view of the helmet 100 and shroud 110. The top shroud 112 may comprise a first attachment 1002 configured to attach the top shroud 112 to the face shield 102 of the helmet 100. The top shroud 112 may comprise a second attachment 1004 configured to attach the top shroud 112 to the head portion 104 of the helmet 100. For example, the attachments 1002 and/or 1004 might comprise channels configured/dimensioned to removably clip (with interference fit) to the face shield 102 or helmet 100 respectively, in some embodiments. In some embodiments, the first attachment 1002 and the second attachment 1004 may be removable from the helmet 100. In some embodiments, the second attachment 1004 may be more easily removable than the first attachment 1002, or vice versa, where different portions of the shroud 110 may be removed at different times for different purposes.

Figure 11:
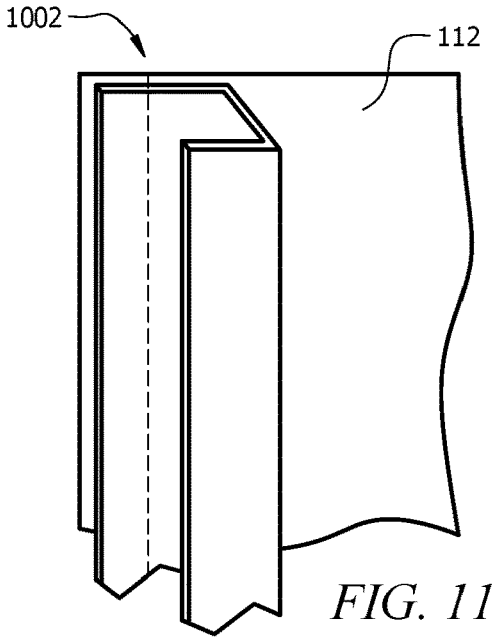
FIG. 11 illustrates a detailed view of an attachment according to an embodiment of the disclosure.

FIG. 11 illustrates a detailed view of the first attachment 1002, which may be sewn onto (or other attached to) the top shroud 112. In the embodiment of FIG. 11, the first attachment 1002 may comprise a rubber profile configured to fit into a slot around the edge of the face shield 102 of the helmet 100.

Figure 12:
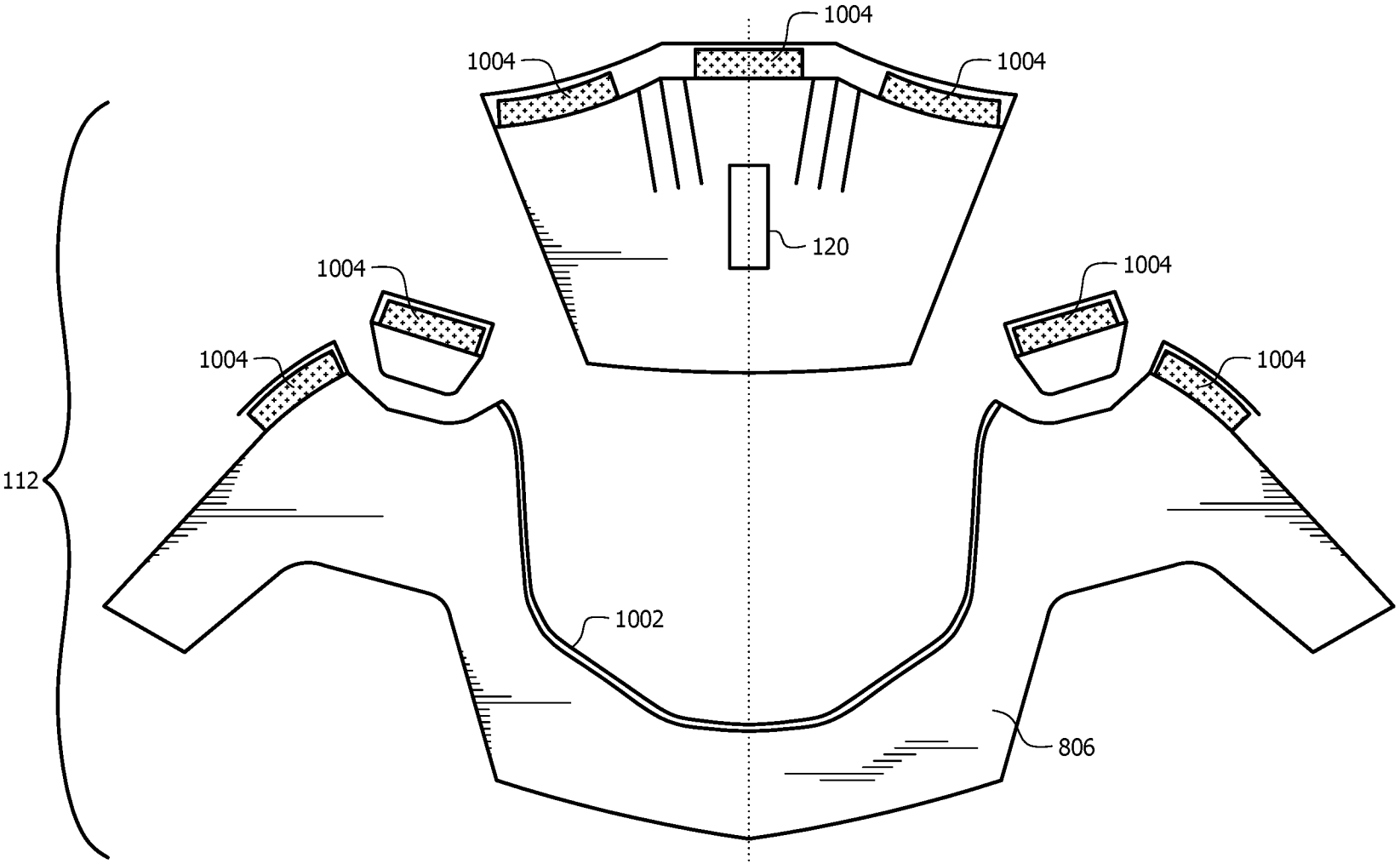
FIG. 12 illustrates a disassemble view of a shroud and an attachment system according to an embodiment of the disclosure.

FIG. 12 illustrates a detailed view of the second attachment 1004, which may be sewn onto (or other attached to) the top shroud 112. In the embodiment of FIG. 12, the second attachment 1004 may comprise a plurality of Velcro panels configured to attach to corresponding panels on the head portion 104 of the helmet 100.

Figure 13:
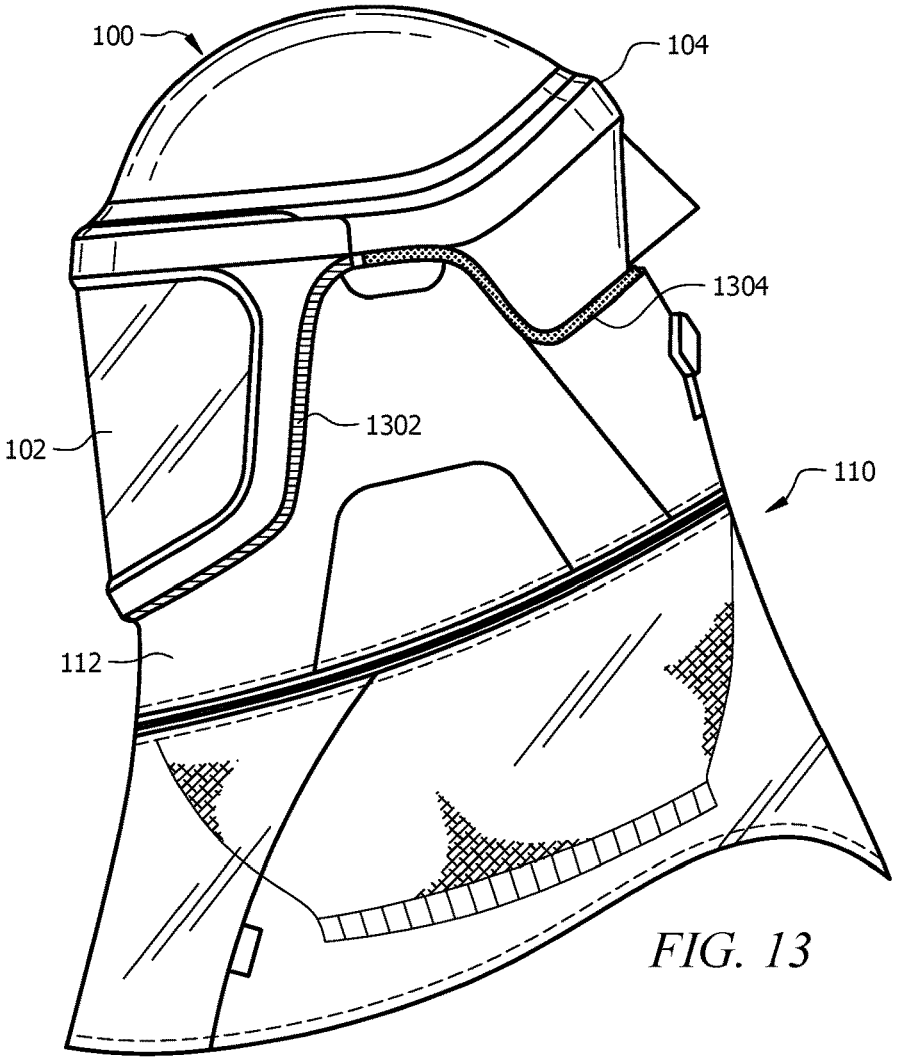
FIG. 13 illustrates a side view of a helmet and shroud comprising another attachment system according to an embodiment of the disclosure.

FIG. 13 illustrates a side view of the helmet 100 and shroud 110. The top shroud 112 may comprise a first attachment 1302 configured to attach the top shroud 112 to the face shield 102 of the helmet 100. The top shroud 112 may comprise a second attachment 1304 configured to attach the top shroud 112 to the head portion 104 of the helmet 100.

Figure 14A:
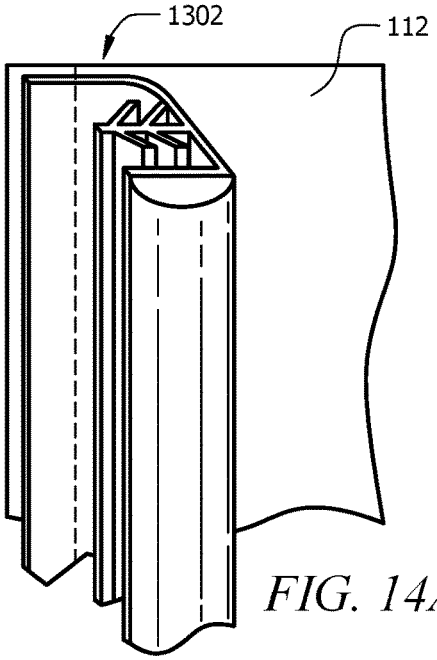
FIGS. 14A-14B illustrate a detailed view of another attachment according to an embodiment of the disclosure.
Figure 14B:
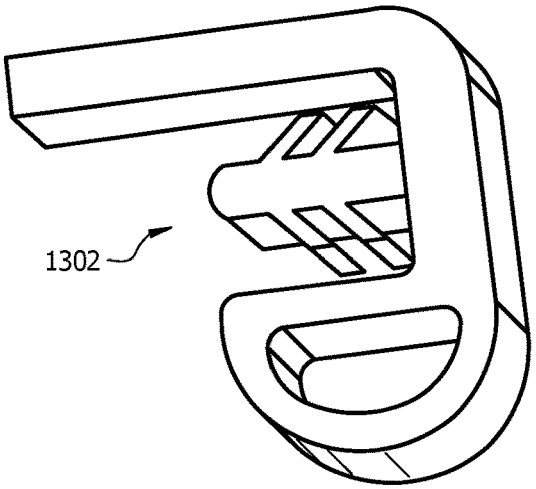

FIGS. 14A-14B illustrate a detailed view of the first attachment 1302, which may be sewn onto (or other attached to) the top shroud 112. In the embodiment of FIGS. 14A-14B, the first attachment 1302 may comprise a rubber profile configured to fit into a slot around the edge of the face shield 102 of the helmet 100.

Figure 15A:
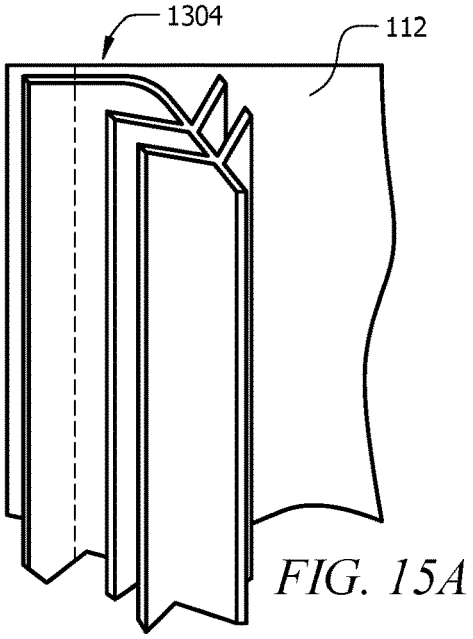
FIGS. 15A-15B illustrate a detailed view of another attachment according to an embodiment of the disclosure.
Figure 15B:
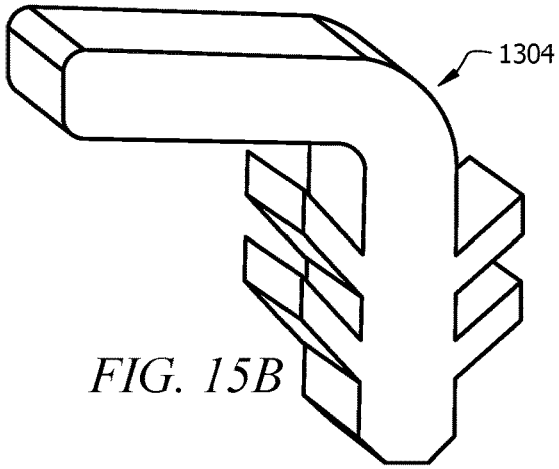

FIGS. 15A-15B illustrate a detailed view of the second attachment 1304, which may be sewn onto (or other attached to) the top shroud 112. In the embodiment of FIGS. 15A-15B, the second attachment 1304 may comprise a rubber profile configured to fit into a slot around the edge of the head portion 104 of the helmet 100.

Figure 16:
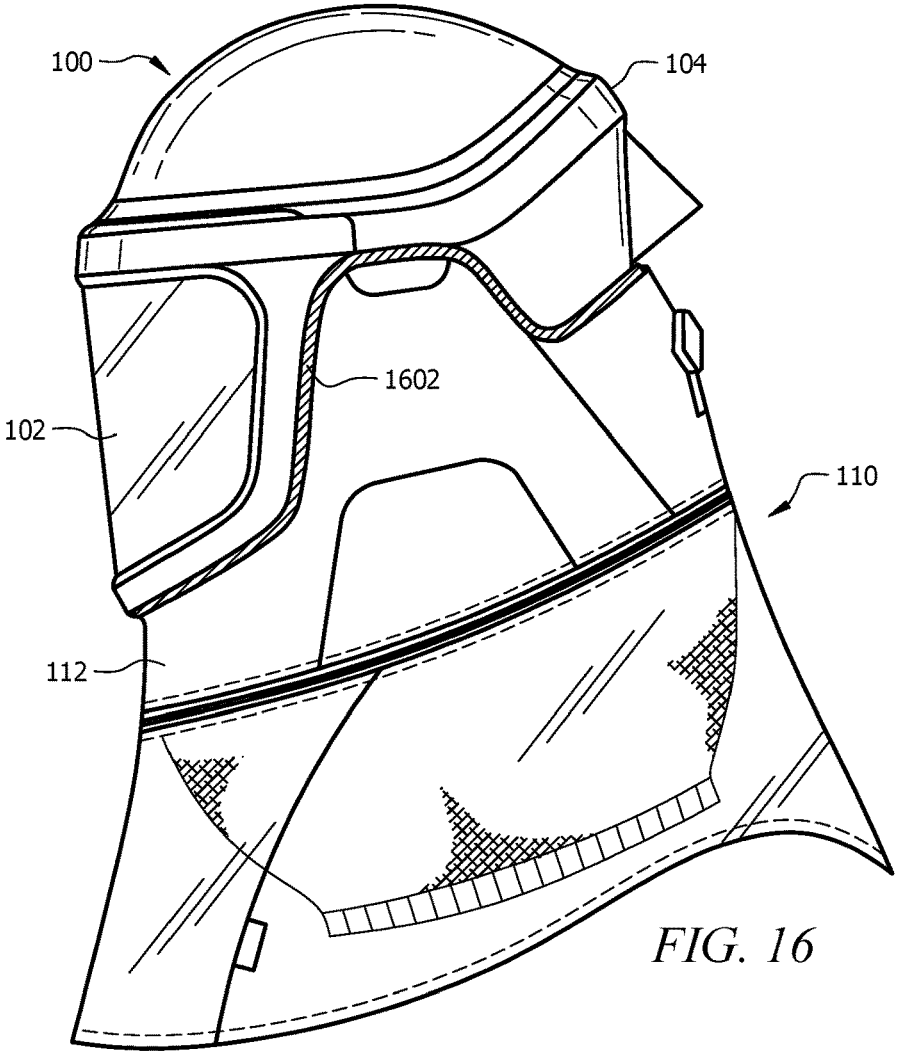
FIG. 16 illustrates a side view of a helmet and shroud comprising another attachment system according to an embodiment of the disclosure.

FIG. 16 illustrates another side view of the helmet 100 and shroud 110, where the top shroud 112 may attach to the helmet 100 via one continuous attachment 1602. The continuous attachment 1602 may comprise a rubber profile configured to fit into a slot around the edge of the face shield 102 and/or helmet 100. In some embodiments, the attachment 1602 may comprise any one of the attachments described above in FIGS. 10-15B.

Some embodiments of the disclosure may include a method of making a shroud for use with a helmet. A method may comprise providing a top shroud, an inner shroud, and an outer shroud. The method may comprise permanently attaching the inner shroud to the top shroud. The method may comprise removably attaching the outer shroud to the top shroud and/or the inner shroud.

In some embodiments, providing the top shroud may comprise forming the top shroud by joining panel segments (see FIG. 8). In some embodiments, providing the outer shroud may comprise forming the outer shroud by joining panel segments (see FIG. 8).

Some embodiments of the disclosure may include a method of using a shroud with a helmet, earmuffs, and/or a PAPR. The method may comprise removably attaching an entire shroud to a helmet and/or face shield. The method may comprise removing an outer shroud (e.g. by unzipping and doffing) while user is wearing a top shroud and an inner shroud.

In some embodiments, the method may comprise placing a helmet on the user's head, with the bottom of the inner shroud around the user's neck forming a close fit, and with the outer shroud over the user's shoulders. In some embodiments, the method may comprise attaching the outer shroud to the top shroud and/or inner shroud (removably, e.g. by zipping onto top shroud and/or inner shroud). In some embodiments, the method may comprise placing the shroud over earmuffs worn by the user (e.g. by stretching an elastic band to create volume space within the top shroud.

Having described various devices and methods herein, exemplary embodiments or aspects can include, but are not limited to:

In a first embodiment, a shroud for use with a helmet may comprise a top shroud configured to attach to the helmet; an inner shroud configured to attach to the top shroud, wherein the inner shroud comprises a band configured to tighten around a user's neck; and an outer shroud configured to removably attach to the top shroud, wherein the outer shroud is configured to cover a user's shoulders.

A second embodiment can include the shroud of the first embodiment, further comprising a zipper between the outer shroud and top shroud, wherein the outer shroud is removable via the zipper.

A third embodiment can include the shroud of the first or second embodiments, wherein the top shroud is shaped to fit around earmuffs worn by the user under the top shroud.

A fourth embodiment can include the shroud of any of the first through third embodiments, wherein the inner shroud is permanently attached to the top shroud.

A fifth embodiment can include the shroud of any of the first through fourth embodiments, wherein the top shroud attaches to the helmet via one or more removable attachments.

A sixth embodiment can include the shroud of the fifth embodiment, wherein the one or more removable attachments comprise a first attachment attached to a portion of the shroud configured to attach to a face shield of the helmet, and a second attachment attached to another portion of the shroud configured to attach to a head portion of the helmet.

A seventh embodiment can include the shroud of the fifth or sixth embodiment, wherein at least one removable attachment comprises channels configured to removably clip to the helmet An eighth embodiment can include the shroud of any of the fifth through seventh embodiments, wherein at least one removable attachment comprises a rubber profile configured to fit into a slot around the edge of at least a portion of the helmet.

A ninth embodiment can include the shroud of any of the first through eighth embodiments, further comprising a button hole configured to allow access to at least a portion of the helmet while still sealing the interior of the shroud.

A tenth embodiment can include the shroud of the ninth embodiment, wherein the button hole allows access to an adjustment wheel of the helmet.

In an eleventh embodiment, a method for attaching a shroud to a helmet may comprise removably attaching a shroud to at least a portion of a helmet, wherein the shroud comprises a top shroud, an inner shroud, and an outer shroud; removing the outer shroud while a user is wearing the top shroud and the inner shroud; and protecting the user while wearing the shroud and the helmet.

A twelfth embodiment can include the method of the eleventh embodiment, further comprising sealing the inner shroud to the user's neck via a band of the inner shroud.

A thirteenth embodiment can include the method of the twelfth embodiment, further comprising removably attaching the outer shroud to at least one of the top shroud and the inner shroud via a zipper.

A fourteenth embodiment can include the method of any of the eleventh through thirteenth embodiments, wherein removably attaching the shroud to at least a portion of a helmet comprises attaching a portion of the shroud to a face shield of helmet, and attaching a portion of the shroud to a head portion of helmet.

A fifteenth embodiment can include the method of any of the eleventh through fourteenth embodiments, wherein removably attaching the shroud to at least a portion of a helmet comprises attaching a portion of the shroud to a face shield of helmet via a first removable attachment, and attaching a portion of the shroud to a head portion of helmet via a second removable attachment.

In a sixteenth embodiment, a method of making a shroud for use with a helmet may comprise providing a top shroud, an inner shroud, and an outer shroud; permanently attaching the inner shroud to the top shroud; removably attaching the outer shroud to at least one of the top shroud and the inner shroud; and attaching one or more removable attachments configured to attach the shroud to the helmet.

A seventeenth embodiment can include the method of the sixteenth embodiment, wherein providing the top shroud comprises forming the top shroud by joining panel segments, and wherein providing the outer shroud comprises forming the outer shroud by joining panel segments.

An eighteenth embodiment can include the method of the sixteenth or seventeenth embodiments, wherein providing the top shroud comprises forming the top shroud to fit over earmuffs worn by the user when the top shroud is positioned over a user's head.

A nineteenth embodiment can include the method of any of the sixteenth through eighteenth embodiments, further comprising forming a band onto the inner shroud configured to seal with the user's neck.

A twentieth embodiment can include the method of any of the sixteenth through nineteenth embodiments, further comprising forming a button hole configured to allow access to at least a portion of the helmet while still sealing the interior of the shroud.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A shroud for use with a helmet, the shroud comprising:

a top shroud configured to removably attach to the helmet, wherein the top shroud includes an elastic band is configured to transition between a first configuration having a reduced volume and a second configuration having an expanded volume to fit around earmuffs worn by a user under the top shroud;

an inner shroud configured to attach to the top shroud, wherein the inner shroud comprises a band configured to tighten around a user's neck; and an outer shroud configured to removably attach to the top shroud, wherein the outer shroud is configured to cover a user's shoulders.

2. The shroud of claim 1, further comprising a zipper between the outer shroud and the top shroud, wherein the outer shroud is removable via the zipper.

3. The shroud of claim 1, wherein the inner shroud is permanently attached to the top shroud.

4. The shroud of claim 1, wherein the top shroud attaches to the helmet via one or more removable attachments.

5. The shroud of claim 4, wherein the one or more removable attachments comprise a first attachment attached to a portion of the shroud configured to attach to a face shield of the helmet, and a second attachment attached to another portion of the shroud configured to attach to a head portion of the helmet.

6. The shroud of claim 4, wherein at least one removable attachment comprises channels configured to removably clip to the helmet.

7. The shroud of claim 4, wherein at least one removable attachment comprises a rubber profile configured to fit into a slot around an edge of at least a portion of the helmet.

8. The shroud of claim 1, further comprising a button hole, wherein the button hole is configured to allow access to at least a portion of the helmet while still sealing an interior of the shroud, and wherein a back top portion comprises one or more pleats.

9. The shroud of claim 8, wherein the button hole allows access to an adjustment wheel of the helmet.

10. A method for attaching a shroud to a helmet, the method comprising:

removably attaching a shroud to at least a portion of a helmet, wherein the shroud comprises a top shroud, an inner shroud, and an outer shroud, wherein the top shroud includes an elastic band is configured to transition between a first configuration having a reduced volume and a second configuration having an expanded volume to fit around earmuffs worn by a user under the top shroud;

removing the outer shroud while a user is wearing the top shroud and the inner shroud; and protecting the user while wearing the shroud and the helmet.

11. The method of claim 10, further comprising sealing the inner shroud to a user's neck via a band of the inner shroud.

12. The method of claim 11, further comprising removably attaching the outer shroud to at least one of the top shroud and the inner shroud via a zipper.

13. The method of claim 10, wherein removably attaching the shroud to at least a portion of the helmet comprises attaching a portion of the shroud to a face shield of the helmet, and attaching a portion of the shroud to a head portion of the helmet.

14. The method of claim 10, wherein removably attaching the shroud to at least a portion of the helmet comprises attaching a portion of the shroud to a face shield of the helmet via a first removable attachment, and attaching a portion of the shroud to a head portion of the helmet via a second removable attachment.

15. A method of making a shroud for use with a helmet, the method comprising:

providing a top shroud, an inner shroud, and an outer shroud, wherein the top shroud includes an elastic band is configured to transition between a first configuration having a reduced volume and a second configuration having an expanded volume to fit around earmuffs worn by a user under the top shroud;

removably attaching the top shroud with the helmet;

permanently attaching the inner shroud to the top shroud;

removably attaching the outer shroud to at least one of the top shroud and the inner shroud; and attaching one or more removable attachments configured to attach the shroud to the helmet.

16. The method of claim 15, wherein providing the top shroud comprises forming the top shroud by joining panel segments, and wherein providing the outer shroud comprises forming the outer shroud by joining the panel segments.

17. The method of claim 15, wherein providing the top shroud comprises transitioning the top shroud between a first configuration having a reduced volume and a second configuration having an expanded volume to fit over earmuffs worn by a user when the top shroud is positioned over a user's head.

18. The method of claim 15, further comprising forming a band onto the inner shroud configured to seal with a user's neck.

19. The method of claim 15, further comprising allowing access, via a button hole, to at least a portion of the helmet while still sealing an interior of the shroud.

* * * * *